United States Patent [19]

Eller

[11] 4,029,078

[45] June 14, 1977

[54] ANDIRON FOR CONTROLLED BURNING OF LOGS

[76] Inventor: Robert E. Eller, 234 SW. 129th, Seattle, Wash. 98188

[22] Filed: Aug. 30, 1976

[21] Appl. No.: 718,944

[52] U.S. Cl. ..... 126/298; D7/211; 211/49 R; 211/175

[51] Int. Cl.[2] ..... F24B 13/00

[58] Field of Search ..... 126/153, 164, 165, 298; D7/206, 207, 211; 211/49 R, 49 D, 175

[56] References Cited

UNITED STATES PATENTS

| | | | |
|---|---|---|---|
| 2,585,523 | 2/1952 | Wellman | 126/164 |
| 2,600,753 | 6/1952 | Gilbert | 126/298 |
| 2,985,165 | 5/1961 | Peterson et al. | 126/165 |

*Primary Examiner*—Ronald C. Capossela
*Attorney, Agent, or Firm*—Graybeal, Barnard & Uhlir

[57] ABSTRACT

The andiron comprises four corner posts and upper and lower sets of horizontal log support bars. The lower bars are continuous and are adapted to support a plurality of logs in a horizontal position above the floor of a fireplace. One of the upper bars is continuous and the other is open at its center. The open centered bar has two end portions, each of which is adapted to support at least one log in a horizontal position above the lower logs. The open center permits one or more additional logs to be placed diagonally, with the lower ends(s) thereof on the lower set of logs and the opposite end(s) on the continuous upper support bar. The sloping attitude of the additional log(s) facilitates both its ignition and the ignition of the upper set of logs. As the logs burn they eventually break at their centers and fall downwardly into the confines of the andiron, usually into diagonal positions with their outer ends supported on one of the cross members.

8 Claims, 7 Drawing Figures

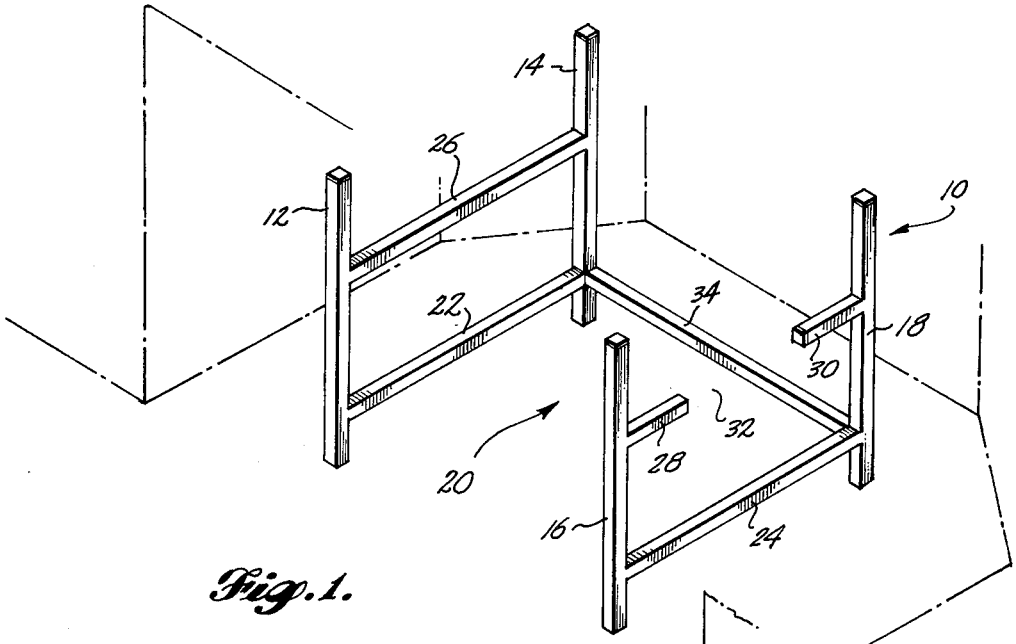
Fig. 1.
Fig. 2.
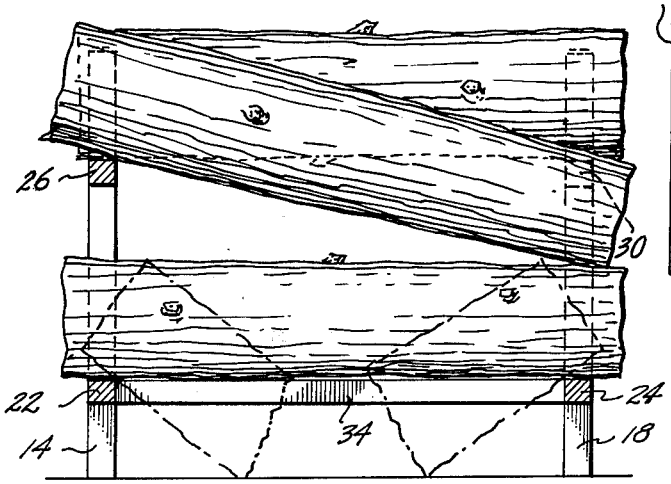
Fig. 4.
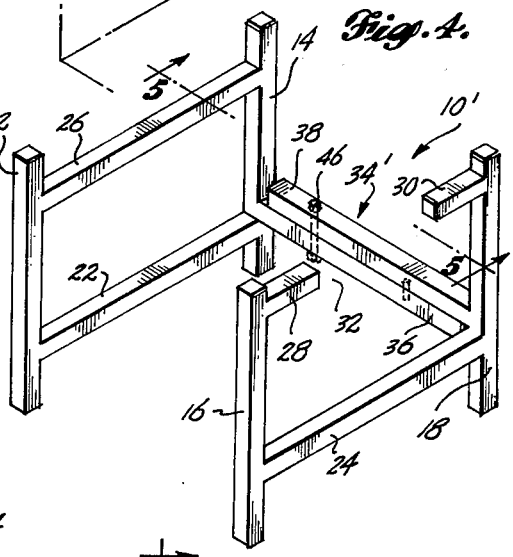
Fig. 3.
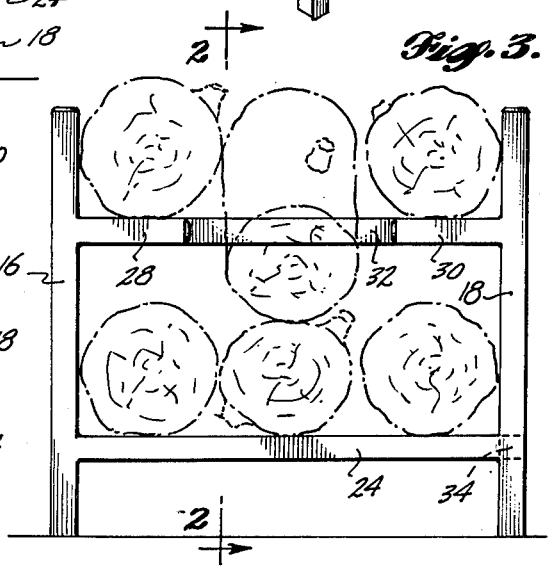
Fig. 5.
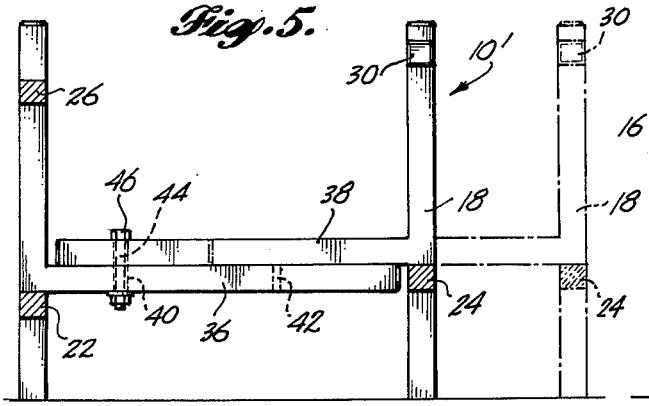

Fig. 6.
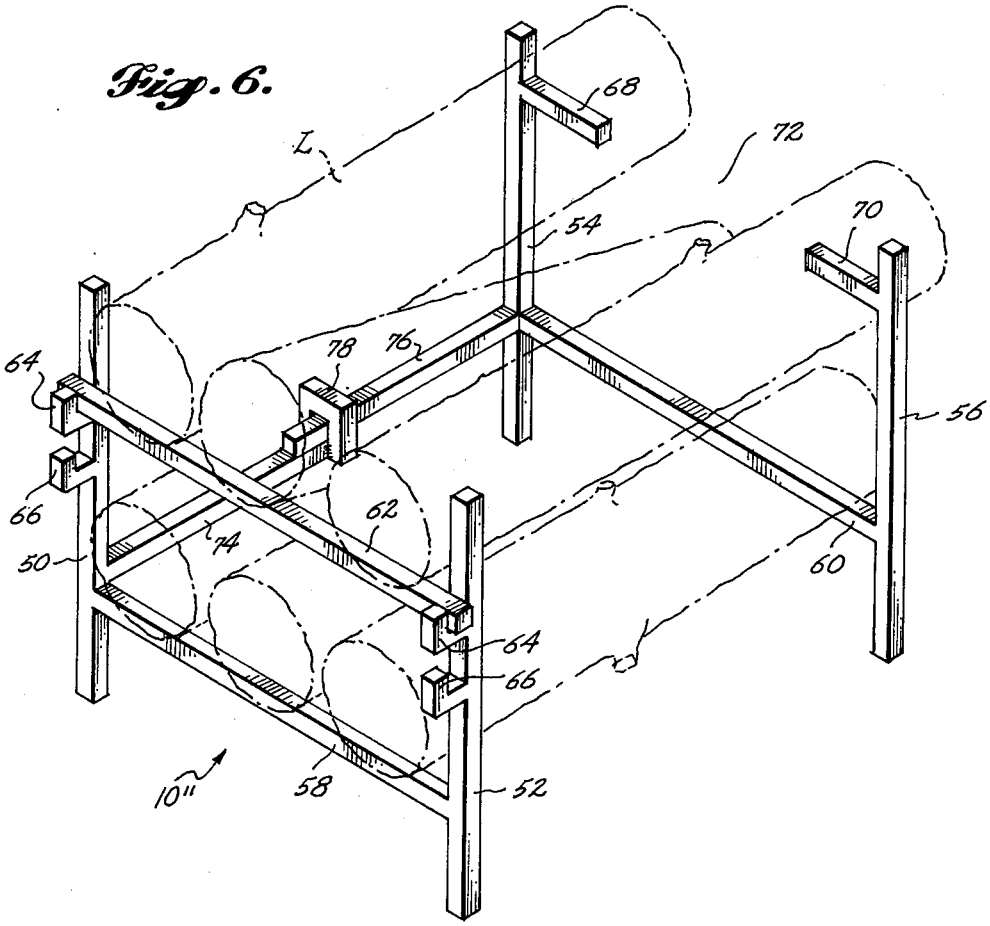
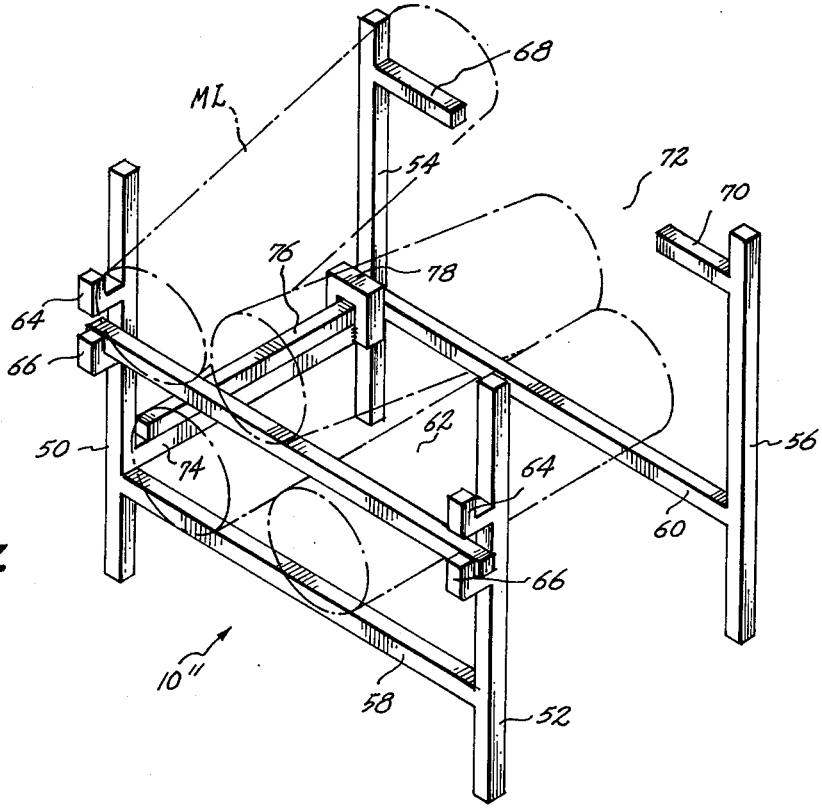
Fig. 7.

ANDIRON FOR CONTROLLED BURNING OF LOGS

BACKGROUND OF THE INVENTION

1. Field of the Invention

This invention relates to a fireplace andiron, and more particularly to the provision of an andiron that is especially constructed for facilitating and controlling the burning of a plurality of stacked logs.

2. Description of the Prior Art

Andirons constructed for supporting logs at two levels are generally known. Examples of prior art andirons of this type are disclosed by the following United States Pats.: No. 744,083, granted Nov. 17, 1903, to Abbot A. Low; No. 909,756 granted Jan. 12, 1909 to Daniel W. Cherry; No. 2,585,523, granted Feb. 12, 1952, to Russell E. Wellman; No. 2,600,753, granted June 17, 1952, to Harold H. Gilbert; No. 2,985,165, granted May 23, 1961, to John W. Peterson and Kazuo A. Yamakawa; No. 3,670,714, granted June 20, 1972, to Leonard Eyges; and Des. 196,997, granted Nov. 26, 1963, to Ed Falkenberg and Edwin S. Lagoe.

Generally speaking, the purpose of the andirons disclosed by the aforementioned patents is to support a plurality of logs at a particular predetermined spacing from each other, for the purpose of facilitating burning. This is also a general purpose of the andiron of this invention. However, I have discovered a quite simple, but yet effective, construction of an andiron which will, in my opinion, produce an easier start of combustion, and will control the burning of a plurality of logs in such a way that partially burned logs are less likely to fall down flat on the floor of the fireplace and become smothered.

SUMMARY OF THE INVENTION

Andirons according to the present invention are characterized by a construction providing support for a first lower level of logs in an initially horizontal position above the floor of the fireplace, and an upper level of logs spaced generally above the lower level of logs. Some of the upper level of logs are supported in a horizontal position and at least one centrally positioned log is supported so as to extend in a diagonal or slanting position. Its lower end is supported on the lower group of logs and its upper end is supported on an upper support bar portion of the andiron.

During the start of combustion of the sloping attitude of the central log (or logs) facilitates its burning and also the start of combustion of the other upper logs. This is because a flame likes to travel upwardly along a sloping piece of wood. This can be easily witnessed by striking a match, then holding it horizontally until it starts to go out, and then sloping it with the lit end downwardly. Immediately the flame gets larger and starts to travel up the match body.

According to the invention, the andiron comprises four vertical corner posts. A lower support bar is interconnected between each front post and the rear post behind it. Preferably, a connector member extends between the two rear posts, for making a unitary structure of the andiron.

An upper horizontal support bar is interconnected between one of the front posts and its rear post. A centrally open upper support bar is provided at approximately the same level between the other front post and its rear post. It is in effect two short bars extending towards each other in cantilever fashion from the posts, with an open space existing between them.

This construction enables a plurality of logs to be laid generally side-by-side across the two lower support bars. At the upper level at least one log is supported by and between each short bar and a corresponding part of the upper continuous bar, and at least one log is disposed at a slant within the open space. Specifically, its end at the open centered side of the andiron rests on the lower logs and its opposite end rests on the central portion of the upper continuous support bar.

Paper and/or kindling or some other fire starting substance is placed below the layer of logs and/or between the upper and lower layers of logs. At the start of combustion, the burning travels very readily along the lower surface portion of the diagonal center log. It then in turn very readily transfers combustion onto the generally horizontally supported upper logs. As burning progresses to the point that the center portions of the logs burn through, the logs fall downwardly into the confines of the andiron and the yet unburned end portions of the logs almost always fall into an inwardly sloping position, between the lower support bars and the floor of the fireplace. As a result, they continue to occupy a position of partial support above the fireplace floor, and an attitude which will facilitate combustion.

These and other advantageous features, objects and advantages of the present invention will be apparent from the detailed description of the preferred embodiment.

BRIEF DESCRIPTION OF THE DRAWING

FIG. 1 is an isometric view of an andiron of this invention, taken from above and looking towards one side and the front of the andiron as it sets within the firebox of a fireplace, and including a broken line showing of the firebox outline;

FIG. 2 is a vertical sectional view of the andiron, including a showing of a plurality of logs stacked on the andiron prior to the start of combustion, taken substantially along line 2—2 of FIG. 3;

FIG. 3 is an end elevational view of the andiron, looking towards the end thereof which includes the open centered upper support bar;

FIG. 4 is a view similar to FIG. 1, but of a modified embodiment of the invention;

FIG. 5 is a sectional view taken substantially along line 5—5 of FIG. 4;

FIG. 6 is an isometric view of another embodiment of the invention, adjusted to hold relatively large logs; and FIG. 7 is a view like FIG. 6 showing the same andiron adjusted to hold smaller logs, such as man-made logs, e.g. presto logs (trademark).

DESCRIPTION OF THE PREFERRED EMBODIMENTS

Referring to FIGS. 1 – 3 of the drawing, the andiron 10 is shown to comprise four corner posts 12, 14, 16, 18 spaced apart to define a combustion space 20 inbetween them.

Posts 12, 16 are hereinafter referred to as first and second front corner posts and post 14 and 18 are hereinafter referred to as first and second rear corner posts.

A first continuous lower log support bar 22 extends between, and is connected at its ends to, corner posts 12 and 14. A second continuous lower log support bar extends between, and is connected at its ends to, corner posts 16 and 18. Log support bars 22, 24 together constitute a lower support means for supporting a plurality of logs in a generally horizontal position spaced above the fireplace floor, as is shown in FIGS. 2 and 3.

A continuous upper log support bar 26 extends between, and is connected at its ends to, corner posts 12 and 14, above log support bar 22. An open centered upper log support bar means is provided at the opposite side of andiron 10, above log support bar 24. It comprises a pair of short log support bar sections 28, 30 separated by an open space 32 of substantial size. Bar sections 28, 30 project inwardly from the posts 16, 18, in cantilever fashion. In essence, log support means 28, 30 is like log suport bar 26 with its central portion removed.

In preferred form, a single bar extends between, and is connected to, the corner posts 14, 18, and serves to rigidly interconnect the two sides of the andiron 10 so that said andiron 10 is a unitary structure.

Preferably, all portions of the andiron 10 are constructed from bar stock that is substantially square in cross-section. The bar stock may measure approximately ⅞ inch – 1¼ inch on each side. Bars 22, 24 are parallel and at the same level. Bar 34 may be at the same level with bars 22, 24. Bar 26 is parallel to and at the same level with bar sections 28, 30.

As clearly shown by all three figures of the drawing, the andiron 10 is free-standing on the lower ends of the four corner posts 12, 14, 16, 18. Only space exists laterally between the two lower log support bars 22, 24.

In use, a plurality of logs are laid side-by-side on the support bars 22, 24. At least one log is placed on each bar section 28, 30 and a corresponding end portion of log support bar 26. At least one additional log is placed diagonally with its upper end resting on the central portion of support bar 26 and its lower opposite end resting on the logs supported by the bars 22, 24, as is shown by FIGS. 2 and 3. The advantage of this arrangement is that at the start of combustion the sloping log or logs behaves in similar fashion to a match which is held at a slope, with its burning end directed downwardly. The flame at the start of combustion travels upwardly along the sloping log and is larger than it would be because of the sloping attitude of the log. The sloping log then better (compared to a horizontal log) helps ignite the upper level logs. Then, as burning proceeds, and the center of the logs burn through, there is good liklihood that the logs will break and fall downwardly into the confines of the four corner posts, 12, 14, 16, 18, with the yet unburned outer ends thereof coming to rest on one of the bars 22, 24. This would help the still burning end portions burn better and completely.

FIGS. 4 and 5 relate to a modified embodiment of the invention. This embodiment is made to be adjustable in width, between a short log position and a long log position. In this embodiment the rear connector 34' is divided into two overlapping parts. One part, shown connected to post 14, is designated 36. The second part, designated 38, is shown to be connected to post 18 and to directly overlap part 36. Bar member or part 36 may be provided with a pair of spaced apart vertical openings 40, 42. Bar member or part 38 may be provided with a single vertical opening 44. As shown by both FIGS. 4 and 5, the two halves of the andiron may be moved relatively close together so that the opening 44 is aligned with the opening 40. Then, a lock pin 46 is simply dropped into place to hold the two bar members 36, 38 together. Lock pin 46 may be in the nature of a bolt having a head portion which is larger than the opening 44, so that when the pin is dropped downwardly its head will contact and rest against bar member 38. The overlapping relationship of the bar members 36, 38 makes it possible to secure the two halves of the andiron together by use of a single pin 46. Without the pin there would be a tendency for the two halves to fall inwardly towards each other. The pin 46 bears against the walls of the holes 40, 44 and prevents this.

FIG. 5 includes a phantom line showing of the andiron expanded into its wider position. This is simply done by removing the pin 46, then sliding the two halves of the andiron apart until opening 44 is aligned with opening 42, and the reinserting the pin 46 into the new pair of aligned openings 44, 42.

FIG. 5 also shows the upper bar parts 28, 30 slightly elevated above the opposite bar member 36. Bar member 24 is also shown to be elevated above its opposite bar member 24. As should be evident, this arrangement will result in a slight slanting altitude of the upper and lower level of logs in addition to the center log or logs which bridges between the two levels. Of course, this particular feature can be incorporated in a non-adjustable form of the andiron as well as in an adjustable form.

It is to be understood that even though natural logs are illustrated the andiron of this invention can be used to burn manufactured logs and other materials capable of being arranged on the andiron in a similar fashion to logs.

FIGS. 6 and 7 show an embodiment of the invention which is adjustable in yet another dimension. Firstly, this andiron 10'' comprises four corner posts 50, 52, 54, 56, to lower log support bars 58, 60, a continuous upper log support bar 62 and an open centered log support bar 68, 70, as in the earlier embodiments. This embodiment further includes an adjustable rear bar 74, 76, 78. Member 78 is a U-shaped member having its bight directed upwardly and the lower portions of its two legs welded to the side of member 74 at its inward end. The resulting opening in member 78 is sized to snugly receive the cross section of member 76. This snug fit and the square shape of both member 76 and such opening result in member 76 being supported in parallelism with member 74 throughout the full range of adjustment of the two halves of the andiron. Adjustment is accomplished by the user merely moving the two halves either together or apart, with member 76 moving relatively through the opening in member 78.

The additional adjustment in this form of the invention involves the vertical adjustment of member 62. This is simply done by the addition of two pairs of upwardly opening hooks 64 and 66 on the posts 50, 52. Member 62 is separate from the posts 50, 52 and is set into either hook 64 and 66, as illustrated.

In FIG. 6 the two halves of the andiron are spread wide apart and the bar 62 is set into the upper pair of hook 64. The logs L are placed on the andiron in the same manner as discussed in connection with the earlier two embodiments. In this embodiment the two stub bars 68, 70 are positioned at a level above the bar 62 and the bar 60 is positioned at a level above bar 58.

FIG. 7 shows the two halves of the andiron moved relatively together. The adjustable rail 62 is positioned within the lower pair of hooks 66. The andiron is shown supporting four manufactured logs ML (e.g. presto logs). Two of the logs are supported by the lower bars 58, 60. A third log has one end thereof supported by a mid portion of bar 62 and the opposite end thereof, which is in the vicinity of the cut-out 72, supported on and by the lower two logs ML. The fourth log has one end thereof supported on an end portion of bar 62 at its opposite end supported on the stub bar 68. As will be appreciated, all four logs are supported in a sloping attitude.

What is claimed is:

1. An andiron supportable on a fireplace floor, comprising four corner posts spaced apart to define a combustion space between them;

a first continuous lower log support bar extending between, and connected at its ends to, a first front corner post and a first rear corner post located behind it;

a second continuous lower log support bar extending between, and connected at its ends to, a second front corner post and a second rear corner post located behind it;

said first and second lower log support bars together constituting a lower support means for supporting a plurality of logs in a generally horizontal position spaced above the fireplace floor;

a continuous upper log support bar extending between, and connected at its ends to, the first front corner post and the first rear corner post, above the said first continuous lower log support bar;

an open centered upper log support bar means spaced above the second continuous lower log support bar, comprising a pair of log support bar sections connected to the said second front corner post and said second rear corner post, and projecting inwardly from said posts in cantilever fashion towards each other, with a substantial open space existing between their free ends;

said log support bar sections and said continuous upper log support bar constituting a support for a plurality of upper level logs, serving to support such logs in a generally horizontal position spaced above the lower level of logs, and said open space between said two upper bar sections being sized to permit at least one log to be placed diagonally with one end thereof supported on the center portion of the upper continuous log support bar and the opposite end thereof supported on a lower level log within the region of said open space, so that such sloping log will more easily burn at the start of combustion and will promote the generation of a larger flame which will better ignite the upper level logs; and means interconnecting the two rear corner posts, so that said andiron is a unitary structure.

2. An andiron according to claim 1, wherein the four corner posts, the continuous log support bars, and the log support bar sections of the open centered log support are constructed from bar stock that is substantially square in cross-section.

3. An andiron according to claim 1, wherein the andiron is free standing on the lower ends of the four corner posts and only space exists laterally between the two lower log support bars, whereby logs which burn through and break at a location between their ends may fall down into sloping positions with their outer ends supported on said lower log support bars, such sloping position of the partially burned logs serving to facilitate completion of combustion.

4. An andiron according to claim 1, wherein said open centered upper log support bar means is at a higher level than the continuous upper log support bar, so that logs supported at such higher level will slope upwardly from said continuous upper log support bar to said open centered upper log support means.

5. An andiron according to claim 4, wherein said second continuous lower log support bar is located at a level higher than the first continuous lower log support bar, so that logs supported on said lower log support bars will slope upwardly from said first continuous lower log support bar to said second continuous lower log support bar.

6. An andiron according to claim 1, wherein said means interconnecting the two rear corner posts comprises a lower bar member connected to one of said posts and an upper bar member connected to the other post and overlapping the first bar member, at least two horizontally spaced apart vertical openings within one of said bar members, at least one matching vertical opening in the other bar member, and a lock pin that is selectively insertable through said latter opening and one of the former two openings that is aligned therewith, for locking the two bar members together.

7. An andiron according to claim 1, wherein said means interconnecting the two rear corner posts comprises a lower bar member connected to one of said posts and an upper bar member connected to the other post and overlapping the first bar member, with one of said bar members carrying means defining a passageway sized to snugly receive the other bar member, with said snug fit and the lapping relationship of the two bar members serving to lock the two bar members together vertically and horizontally front to rear, while allowing easy adjustment of the respective side portions of the andiron by a relative movement of such bar member through said passage means.

8. An andiron according to claim 1, wherein the continuous upper log support bar is separable from said first front corner post and said first rear corner post, and wherein said first front corner post and said first rear corner post comprise two separate pairs of vertically spaced apart, upwardly opening bracket means for selectively receiving said continuous upper log support bar.

* * * * *